United States Patent [19]

Pakarnseree

[11] 4,263,691

[45] Apr. 28, 1981

[54] BRUSH

[76] Inventor: Seree Pakarnseree, Seree Clinic, 885 Sukhumvit 49, Bangkok, Thailand

[21] Appl. No.: 18,181

[22] Filed: Mar. 7, 1979

[51] Int. Cl.[3] ..... A46B 3/04

[52] U.S. Cl. ..... 15/159 A; 15/167 R; 15/171; 15/193

[58] Field of Search ..... 15/167 R, 159 A, 176, 15/159 R, 171, 193

[56] References Cited

U.S. PATENT DOCUMENTS

| | | | |
|---|---|---|---|
| 2,154,846 | 4/1939 | Hexmann et al. | 15/159 A X |
| 2,244,098 | 6/1941 | Busick | 15/167 R X |
| 2,476,201 | 7/1949 | Liqoure | 15/159 A X |
| 3,007,441 | 7/1961 | Exer | 15/167 R X |
| 3,258,805 | 7/1966 | Rossnan | 15/167 R X |
| 3,327,339 | 6/1967 | Lemelson | 15/159 A X |

*Primary Examiner*—Christopher K. Moore

*Attorney, Agent, or Firm*—Birch, Stewart, Kolasch & Birch

[57] ABSTRACT

A toothbrush comprises a handle and bristles mounted near one end of the handle. Each bristle has a core and a sheath of an elastomer, the elastomer being softer than the core material. The handle or at least the portion of the handle carrying the bristles, has a covering of an elastomer.

6 Claims, 8 Drawing Figures

BRUSH

SUMMARY AND OBJECTS OF THE INVENTION

The invention relates to brushes and in particular to brushes for use in delicate areas, for example toothbrushes.

According to the invention there is provided a brush comprising bristles each having a core surrounded by a sheath of an elastomer, the elastomer being softer than the core material.

According to a further aspect of the invention there is provided a brush comprising bristles mounted in a handle, wherein at least that part of the handle which supports the bristles has a covering of an elastomer.

BRIEF DESCRIPTION OF THE DRAWINGS

The invention will be further described by example and with reference to the accompanying drawings, in which.

DETAILED DESCRIPTION OF THE INVENTION

Figure 1:
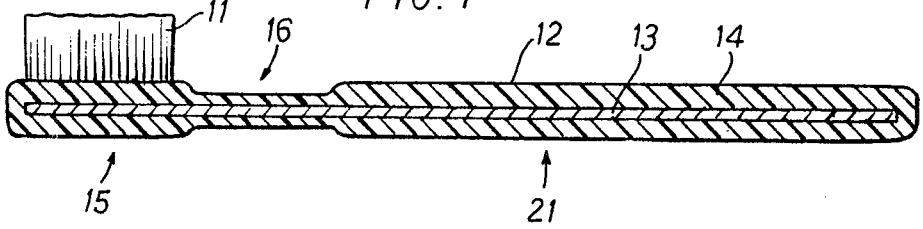
FIG. 1 is a longitudinal section through a toothbrush according to the invention.
Figure 2:
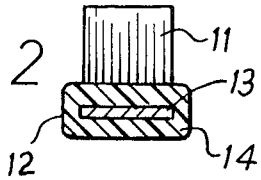
FIG. 2 is a transverse section through the toothbrush shown in FIG. 1.

FIGS. 1 and 2 show a toothbrush constructed according to the invention. The toothbrush has bristles 11 mounted in a rigid handle 12. The handle 12 comprises a core 13 of a rigid material, for example a metal or hard thermoplastic or metal covered with hard thermoplastic 22, and a covering 14 of an elastomer. The covering 14 can be of soft thermoplastic material, such as ethylene vinyl acetate co-polymers, polyethylene or poly-vinyl chloride, or of natural or synthetic rubber. The handle 12 has a head portion 15, in which the bristles 11 are mounted, a body portion 21 intended to be gripped when the brush is being used, and a neck portion 16 connecting the head portion 15 to the body portion 21. The covering of elastomer 14 is thinner on the neck portion 16 than in the head portion 15 or the body portion 21. Securing the bristles in the handle can be achieved in any suitable manner for example, by forming holes 23 in the rigid core 13 of the handle into which tufts of bristles fit tightly. A tuft may consist of a number of bristles folded in half. Such a tuft can be secured in the core of the handle, when a hard thermoplastics material is used in the core, by placing a peg across the fold in the bristles and arranging the tuft, and its associated peg, in the material of the core during moulding of the core.

Figure 3:
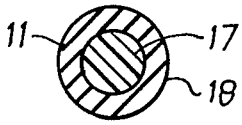
FIG. 3 is a cross-section through a bristle of the toothbrush shown in FIG. 1.

Referring to FIG. 3 a bristle 11 for a toothbrush according to the invention has a stiff core 17 made of a hard thermoplastic such as Nylon 6 or high-density polyethylene. The stiff core 17 is surrounded by a sheath 18 of a softer material. The sheath 18 can be made of a soft thermoplastic material, such as ethylene vinyl acetate co-polymer, polyethylene or poly-vinyl chloride, or of natural or synthetic rubber. If the diameter of the core 17 is d and the outer diameter of the sheath 18 is D then the ratio d/D can be in the range 1/1.01 to 1/2.5.

Figure 4:
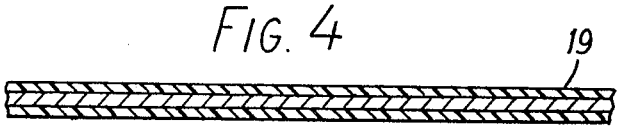
FIG. 4 is a longitudinal section through part of a filament of material from which bristles for a brush according to the invention can be made.
Figure 5:
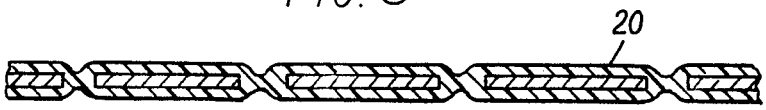
FIG. 5 is a longitudinal section through part of an alternative filament of material from which bristles can be made.
Figure 6:
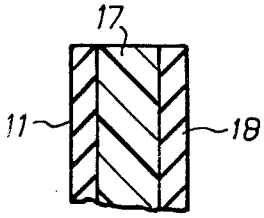
FIG. 6 is a partial longitudinal section through a bristle made from the filament shown in FIG. 4.
Figure 7:
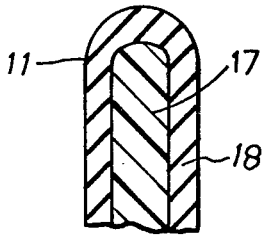
FIG. 7 is a partial longitudinal section through a bristle made from the filament shown in FIG. 5.
Figure 8:
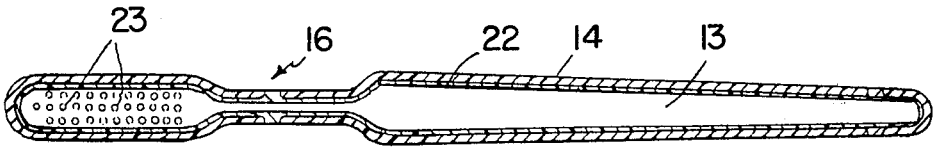
FIG. 8 is a cross-sectional view through the core of a toothbrush according to one embodiment of the present invention.

FIG. 4 shows a part of a filament of material 19 produced by continuous extrusion moulding of a substance suitable for the core 17 and a substance suitable for the sheath 18 of the bristle shown in FIG. 3. The filament 19 may be divided into bristles, at the ends of which the stiff core 17 is exposed. FIG. 6 shows an end of a bristle 11 made from the filament 19. FIG. 5 shows part of a similar filament 20. During the production of the filament 20 the extrusion of the substance of the core was regularly interrupted. The filament 20 can be divided into bristles by severing the substance of the sheath in the gaps between the portions of the core substance. In this way bristles are produced at the ends of which the stiff core 17 is covered by the sheath 18, as shown in FIG. 7.

When using the toothbrush described, there is less chance of damage to the gums, fillings in the teeth and soft tissues in the mouth. This is particularly important for children and for people with oral diseases. The bristles are resilient yet their outer surfaces are soft. When in contact with the gum the sheath 18 of a bristle 11 will deform to give a large area of contact between the bristles and the gum. This feature is advantageous for massage of the gum to improve blood circulation. The handle, in particular the head and the neck can be made thin by using a thin strip of metal as the rigid core, and this is preferable for easy use. In addition, the soft covering on the handle makes it easier to grip. For cleaning the teeth and removing plaque the type of bristle having the stiff core exposed at the end is used, and the bristle having the core covered at the end is preferable for gum massage.

It will be appreciated that although only one toothbrush has been described the invention is not confined to this embodiment. The covering of elastomer on the handle can be incomplete. The head of the handle can be inclined to the remainder of the handle, the relative dimensions of the head, neck and remainder of the handle can be changed. The number of tufts of bristles can vary, for example between 1 and 56. The invention is not confined to toothbrushes, and can be applied to any brushes for use in situations where it is desirable to reduce the risk of damage being caused by the brush.

I claim:

1. A brush comprising:

a handle including a plurality of bristles mounted adjacent to one end of said handle, each of said bristles having a core surrounded by a sheath;

said handle including a metal strip having a plurality of apertures, said bristles being mounted in said apertures; and a body of elastomer material disposed around and embedding the metal strip together with the portion of the bristles which are located in said apertures.

2. A brush according to claim 1, wherein at the free ends of the bristles the cores are exposed.

3. A brush according to claim 1 or 2, wherein the ratio of the diameter of the core to the outer diameter of the sheath is approximately in the range 1:1.01 to 1:2.5.

4. A brush according to claim 1, wherein the handle comprises a head portion in which the bristles are mounted, a body portion intended to be gripped when the brush is being used, and a neck portion connecting the head and body portions, and wherein the handle has a complete covering of an elastomer, the covering on the neck portion being thinner than that on the head or body portions.

5. A brush according to claim 1, wherein said metal strip is coated with a hard plastic material prior to being coated with said elastomer material.

6. A brush according to claim 1, wherein the core of said bristles is constructed of a harder material than the material of the sheath.

* * * * *